US010040605B1

(12) United States Patent
Popier

(10) Patent No.: US 10,040,605 B1
(45) Date of Patent: Aug. 7, 2018

(54) DRYWALL ACCESSORY HOLDER AND ASSOCIATED USE THEREOF

(71) Applicant: Ladislav Popier, East Hanover, NJ (US)

(72) Inventor: Ladislav Popier, East Hanover, NJ (US)

( * ) Notice: Subject to any disclaimer, the term of this patent is extended or adjusted under 35 U.S.C. 154(b) by 0 days.

(21) Appl. No.: 15/655,772

(22) Filed: Jul. 20, 2017

Related U.S. Application Data

(60) Provisional application No. 62/364,351, filed on Jul. 20, 2016.

(51) Int. Cl.

| | |
|---|---|
| ***B65D 85/20*** | (2006.01) |
| ***B65D 25/22*** | (2006.01) |
| ***B65D 43/16*** | (2006.01) |
| ***B25H 3/02*** | (2006.01) |
| *E04F 21/02* | (2006.01) |

(52) U.S. Cl.
CPC ..... *B65D 25/22* (2013.01); *B25H 3/02* (2013.01); *B65D 43/166* (2013.01); *E04F 21/026* (2013.01)

(58) Field of Classification Search
USPC ..... 206/372, 373, 582; 220/485
See application file for complete search history.

(56) References Cited

U.S. PATENT DOCUMENTS 2,301,032 A * 11/1942 Fielding ..... B65B 67/12 220/485
2,541,972 A * 2/1951 Wallace ..... B65D 7/20 215/12.1
2,819,938 A * 1/1958 Zerver ..... A47B 31/00 206/216
4,140,256 A * 2/1979 King ..... B25H 3/04 206/373
5,069,342 A * 12/1991 Dickinson ..... B25H 3/028 206/372
5,257,695 A * 11/1993 Henke ..... B25H 3/023 206/229
5,950,828 A * 9/1999 Bal ..... B25H 3/06 206/370
6,536,590 B1 * 3/2003 Godshaw ..... B25H 3/00 206/373
6,637,592 B1 * 10/2003 Lai ..... B25H 3/023 206/372
2006/0021985 A1 * 2/2006 Jasper ..... B25H 3/02 220/475
2007/0187411 A1 * 8/2007 Mysak ..... B62B 1/26 220/485
2012/0298539 A1 * 11/2012 Purnell, Jr. ..... B25H 3/02 206/372

* cited by examiner

*Primary Examiner* — Jacob K Ackun
(74) *Attorney, Agent, or Firm* — Ashkan Najafi

(57) ABSTRACT

A drywall accessory holder includes a unitary and single receptacle having an open top end and a centrally registered longitudinal axis, the receptacle being suitably sized and shaped for receiving and holding existing glazing compound and the existing accessories therein, a wire frame having a unitary, continuous, and predetermined shape communicatively coupled to the receptacle such that the receptacle is maintained at a substantially stable position, and a lid pivotally coupled to the wire frame in such a manner that the lid is removably positioned entirely along the open top end of the receptacle, wherein the wire frame is capable of being hung from an existing support structure.

7 Claims, 6 Drawing Sheets

DRYWALL ACCESSORY HOLDER AND ASSOCIATED USE THEREOF

CROSS REFERENCE TO RELATED APPLICATIONS

This is a non-provisional patent application that claims the benefit of U.S. provisional patent application No. 62/364,351 filed Jul. 20, 2016, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to dry wall tools and, more particularly, to a drywall accessory holder including a lightweight and durable, easily transported, protective storage unit for a drywall mud-pan, glazing compound, or spackle, as well as a variety of putty and spackle knives. Equipped with a hook (and a small bracelet) for hanging from a wall, ladder, or other structure, the drywall accessory holder keeps vital supplies and tools for drywall finishers, trades workers, repair work professionals, and household do-it-yourselfers, easily accessible, organized, and protected.

Prior Art

Men tease women about all the shoes they have, and women tease men about all their tools. Just why a woman would need thirty or more pairs of shoes, no one knows. But a man can quite easily justify a heavy steel box—or a footlocker on wheels, or an entire room of the house—devoted to tools. Why? It's simple: without the right tool, you quite often cannot perform the task; or worse, in an effort to complete the task, you use the wrong tool and just make matters worse. As a consequence of this fact, men accumulate tools as they encounter new tasks, purchasing the tool required to complete the job at hand. The tools therefore multiply, and the toolbox gets heavier.

Just as a man buys tools as the need for them arises, such tools are invented in response to need. Before the era of sheetrock walls, for example, no one invented anchor-screws because there was no need for them. The story is much the same for the bewildering variety of tools, fasteners, and other equipment to be found in the toolboxes of today's men, whether professional contractors or homeowners with a bent for do-it-yourself projects. Some tools, of course, are indispensable necessities. Among these is the spackle or putty knife—a straight, flat, chisel-edged knife that is produced in various blade-widths, and can be used for jobs as diverse as applying glazing compound to window-panes, filling holes and gouges in wall or ceiling board, and applying joint compound to the joints in sheetrock walls. A construction tradesman or do-it-yourself householder must purchase a range of separate knives to have the full complement of blade-widths that he or she might require—and at six or seven dollars apiece, the cost adds up.

After such an investment, unfortunately, the knives tend to become scratched, rusted, bent, mislaid or lost. This is because there is nothing convenient, protective, and easily accessible in which to keep them.

Accordingly, a need remains for drywall accessory holder in order to overcome at least one aforementioned shortcoming. The exemplary embodiment(s) satisfy such a need by providing a drywall accessory holder including a lightweight and durable, easily transported, protective storage unit that is convenient and easy to use, lightweight yet durable in design, versatile in its applications, and designed for holding a drywall mud-pan, glazing compound, or spackle, as well as a variety of putty and spackle knives. Equipped with a hook (and a small bracelet) for hanging from a wall, ladder, or other structure, the drywall accessory holder keeps vital supplies and tools for drywall finishers, trades workers, repair work professionals, and household do-it-yourselfers, easily accessible, organized, and protected.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a drywall accessory holder for keeping existing accessories at a substantially stable position during drywall applications. These and other objects, features, and advantages of the non-limiting exemplary embodiment(s) are provided by a drywall accessory holder including a unitary and single receptacle having an open top end and a centrally registered longitudinal axis, the receptacle being suitably sized and shaped for receiving and holding existing glazing compound and the existing accessories therein, a wire frame having a unitary, continuous, and predetermined shape communicatively coupled to the receptacle such that the receptacle is maintained at a substantially stable position, and a lid pivotally coupled to the wire frame in such a manner that the lid is removably positioned entirely along the open top end of the receptacle, wherein the wire frame is capable of being hung from an existing support structure.

In a non-limiting exemplary embodiment, the receptacle is a drywall mud-pan intercalated between an anterior portion and a posterior portion of the wire frame.

In a non-limiting exemplary embodiment, the wire frame includes a hook located at the posterior portion, a plurality of linear segments oppositely extending laterally away from the hook, a plurality of U-shaped segments attached to the linear segments, respectively, and extended towards the anterior portion, and a plurality of eyelets connected to the U-shaped segments, respectively.

In a non-limiting exemplary embodiment, the lid includes a plurality of linear slots disposed parallel to the centrally registered longitudinal axis.

In a non-limiting exemplary embodiment, the wire frame includes a plurality of fasteners pivotally coupled to the eyelets and the lid such that the lid is articulated, between an open position and a closed position, about a fulcrum axis oriented parallel to the centrally registered longitudinal axis.

In a non-limiting exemplary embodiment, a flexible wire strap is spaced from the wire frame, the receptacle, and the lid. In this manner, the flexible wire strap is selectively morphed to a desired shape and engaged to the existing accessories for maintaining the existing accessories at a substantially stable position during drywall applications.

In a non-limiting exemplary embodiment, the lid hangs downwardly and in front of the anterior portion when adapted to the open position.

In a non-limiting exemplary embodiment, the receptacle is cradled within the U-shaped segments.

The present disclosure further includes a method of utilizing a drywall accessory holder for keeping existing accessories at a substantially stable position during drywall applications. Such a method includes the steps of: providing a unitary and single receptacle having an open top end and a centrally registered longitudinal axis wherein the receptacle is suitably sized and shaped for receiving and holding existing glazing compound and the existing accessories therein; providing and communicatively coupling a wire frame having a unitary, continuous, and predetermined shape to the receptacle such that the receptacle is maintained at a substantially stable position; providing and pivotally coupling a lid to the wire frame in such a manner that the lid is removably positioned entirely along the top opening of the receptacle; and hanging the wire frame from an existing support structure.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
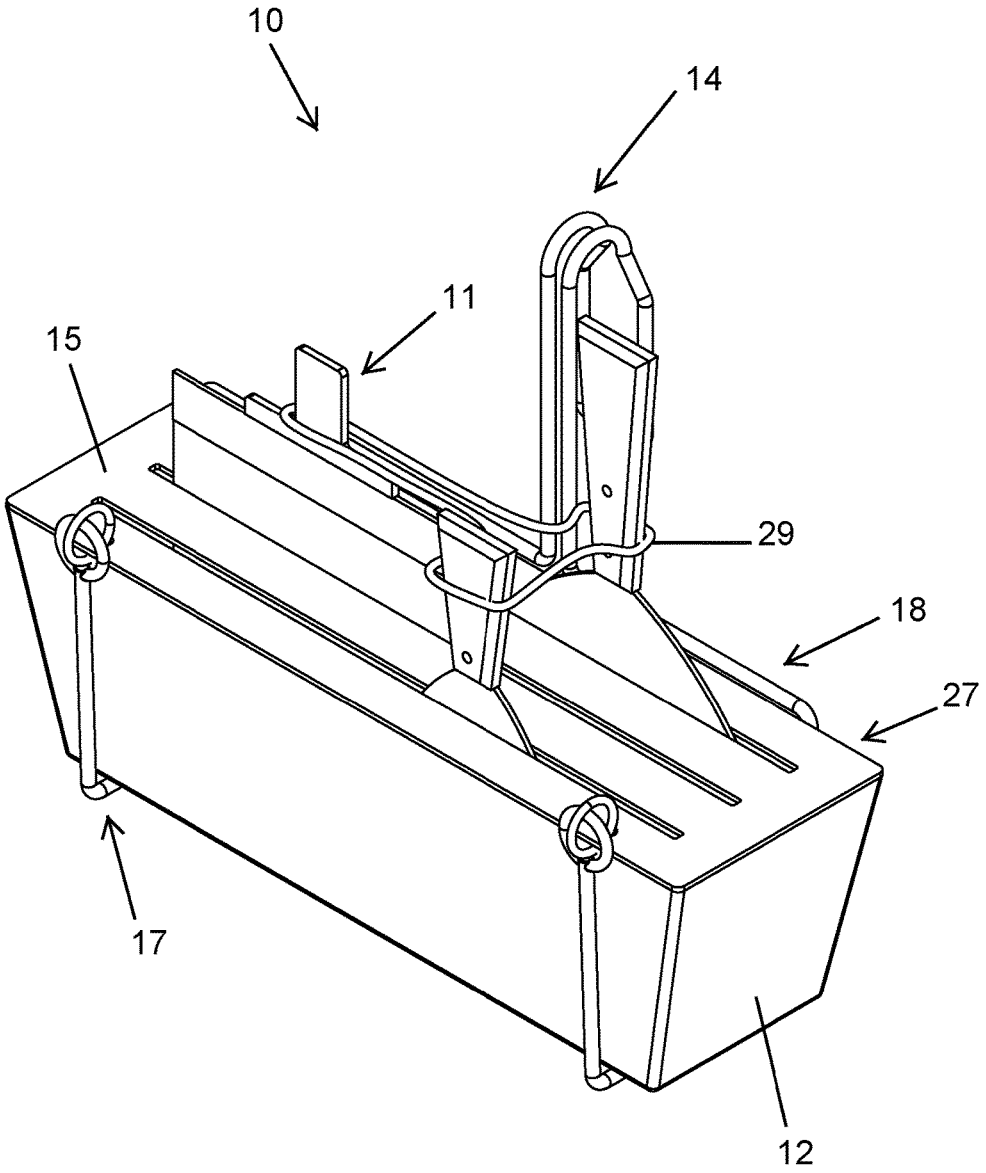
FIG. 1 is a drywall accessory holder supporting a plurality of existing accessories in a receptacle, in accordance with a non-limiting exemplary embodiment.
Figure 2:
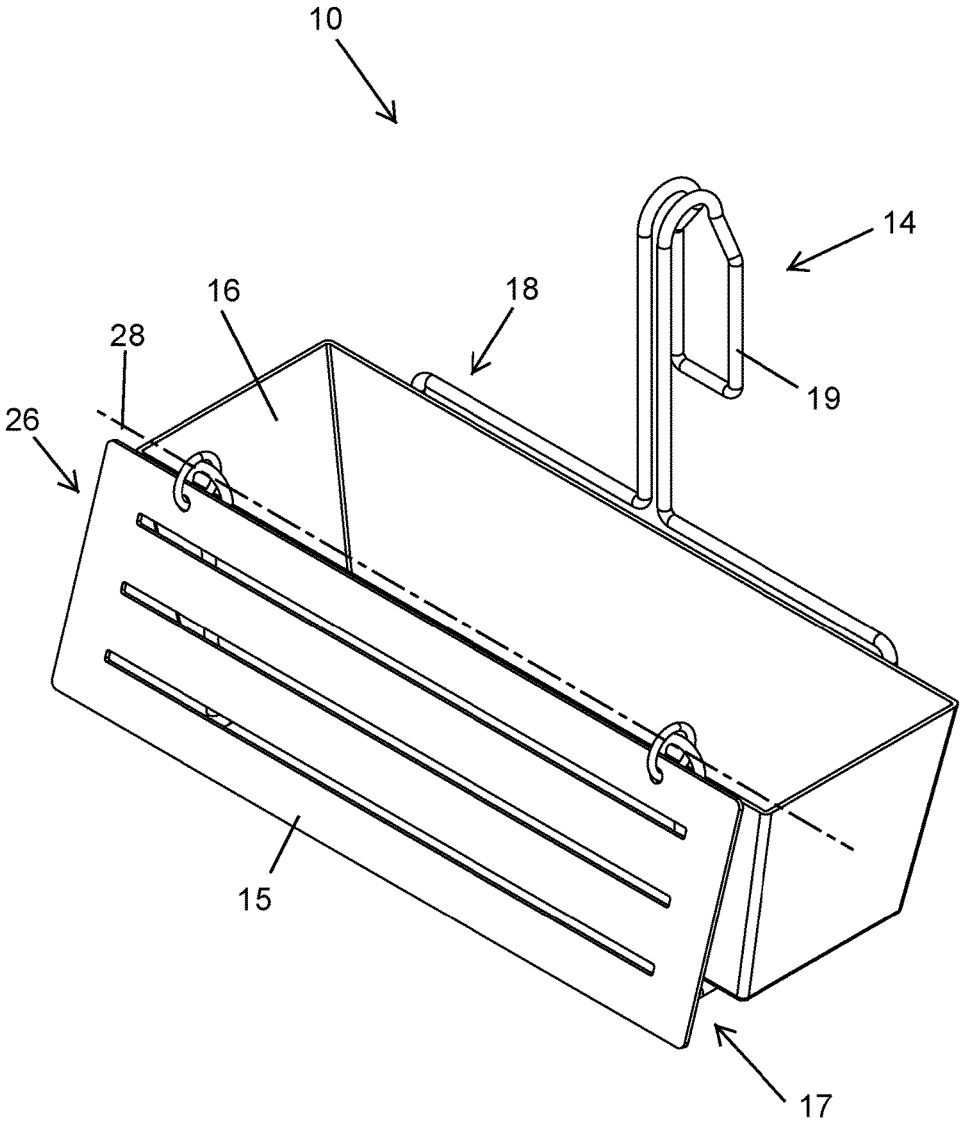
FIG. 2 is a perspective view the drywall accessory holder shown in claim 1 wherein the accessories are removed from the receptacle and a lid is articulated to an open position.
Figure 3:
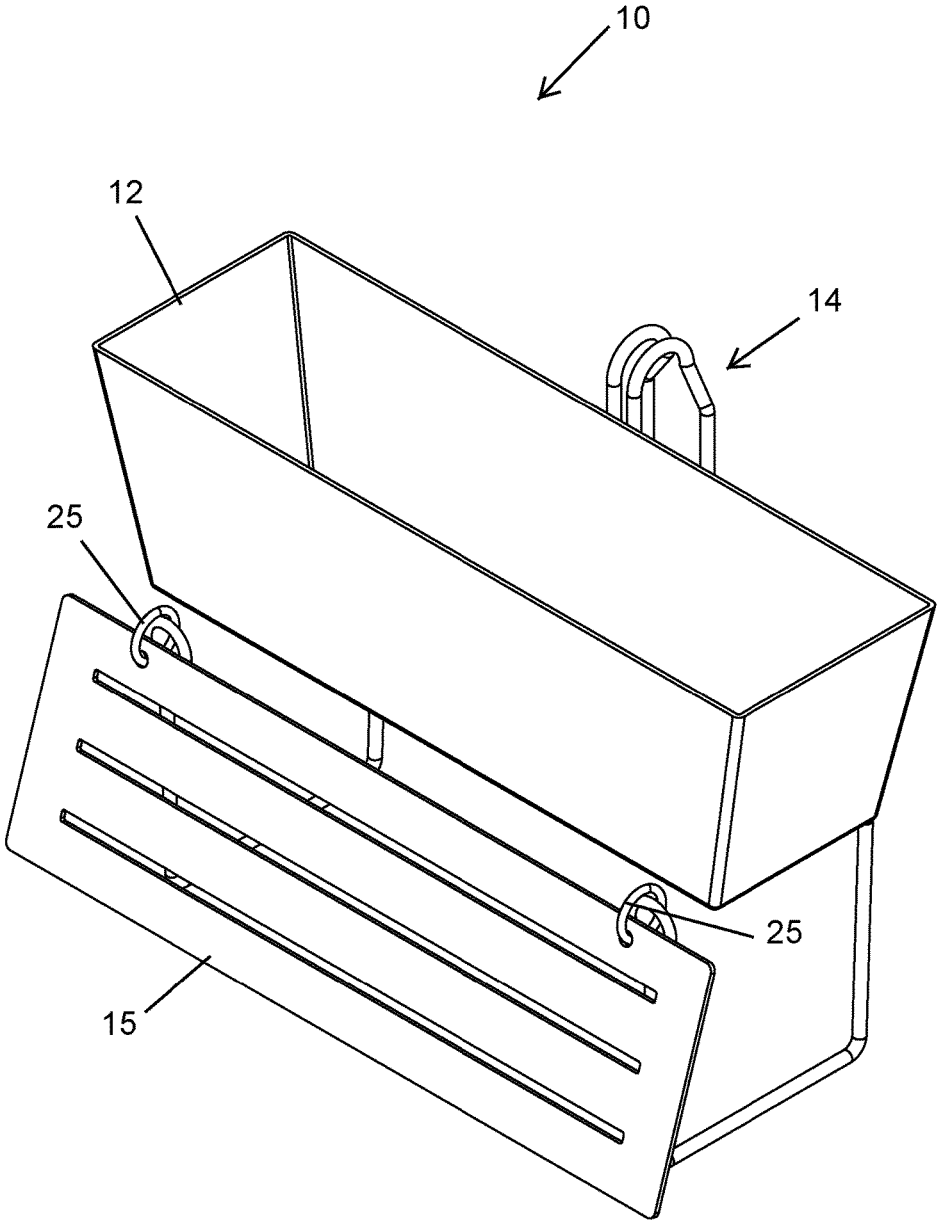
FIG. 3 is an exploded view of the drywall accessory holder shown in FIG. 2.
Figure 4:
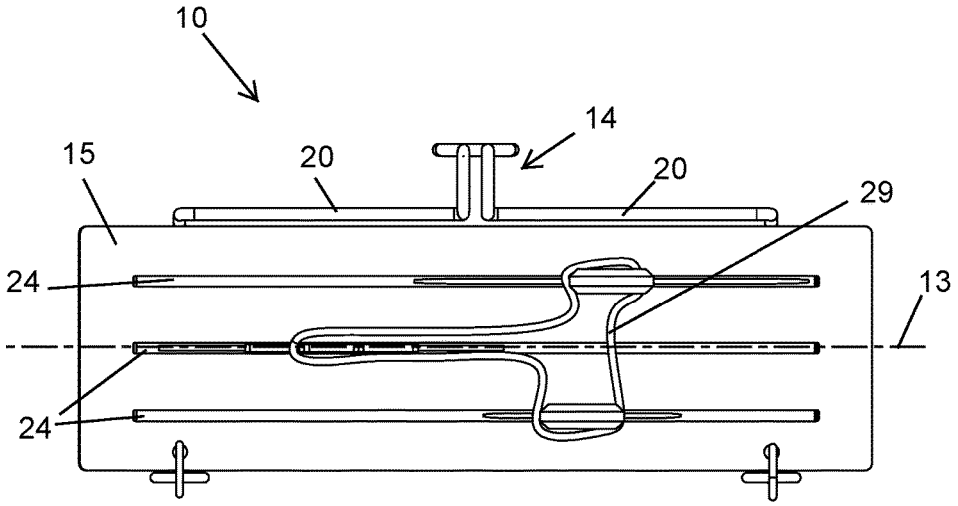
FIG. 4 is a top plan view of the drywall accessory holder shown in FIG. 1.
Figure 5:
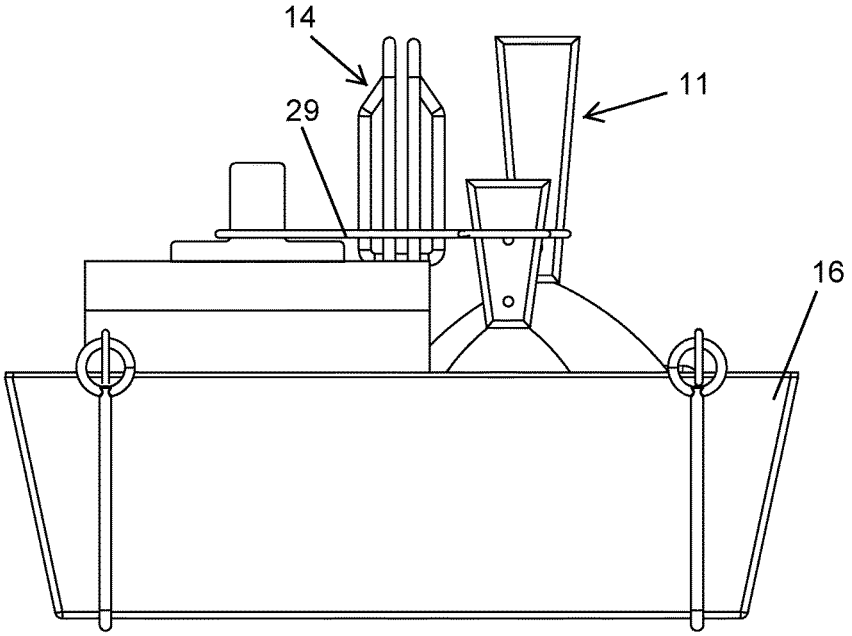
FIG. 5 is a side elevational view of the drywall accessory holder shown in FIG. 1.
Figure 6:
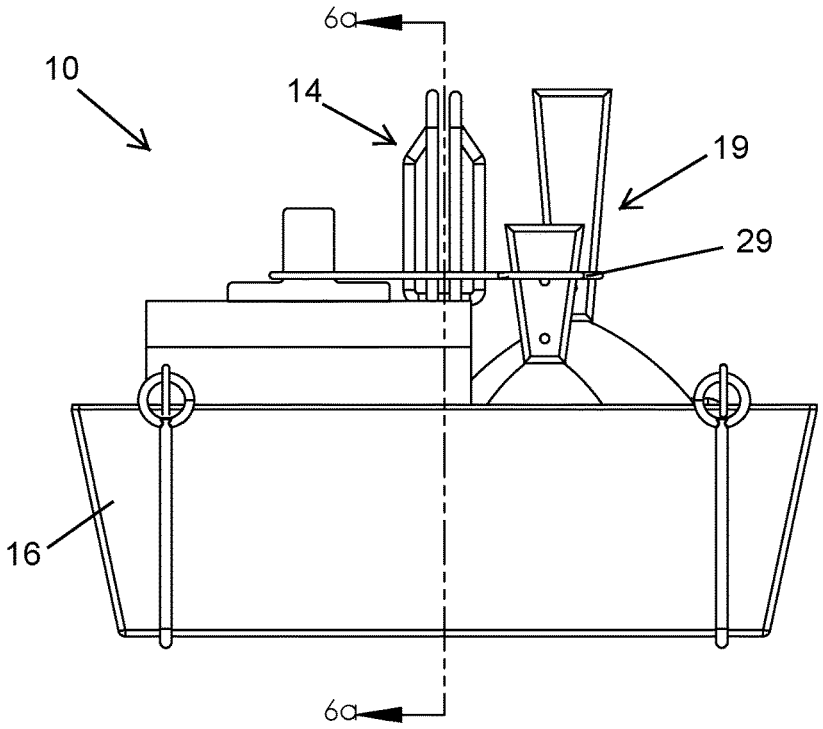
FIG. 6 is a side elevational view of the drywall accessory holder shown in FIG. 1 wherein a cross-sectional line **6*a*-6*a*** is illustrated.
Figure 6A:
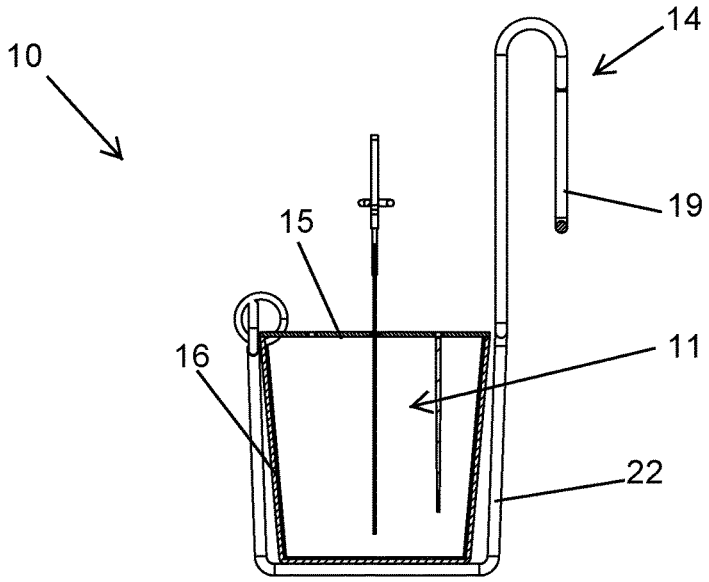
Figure 7:
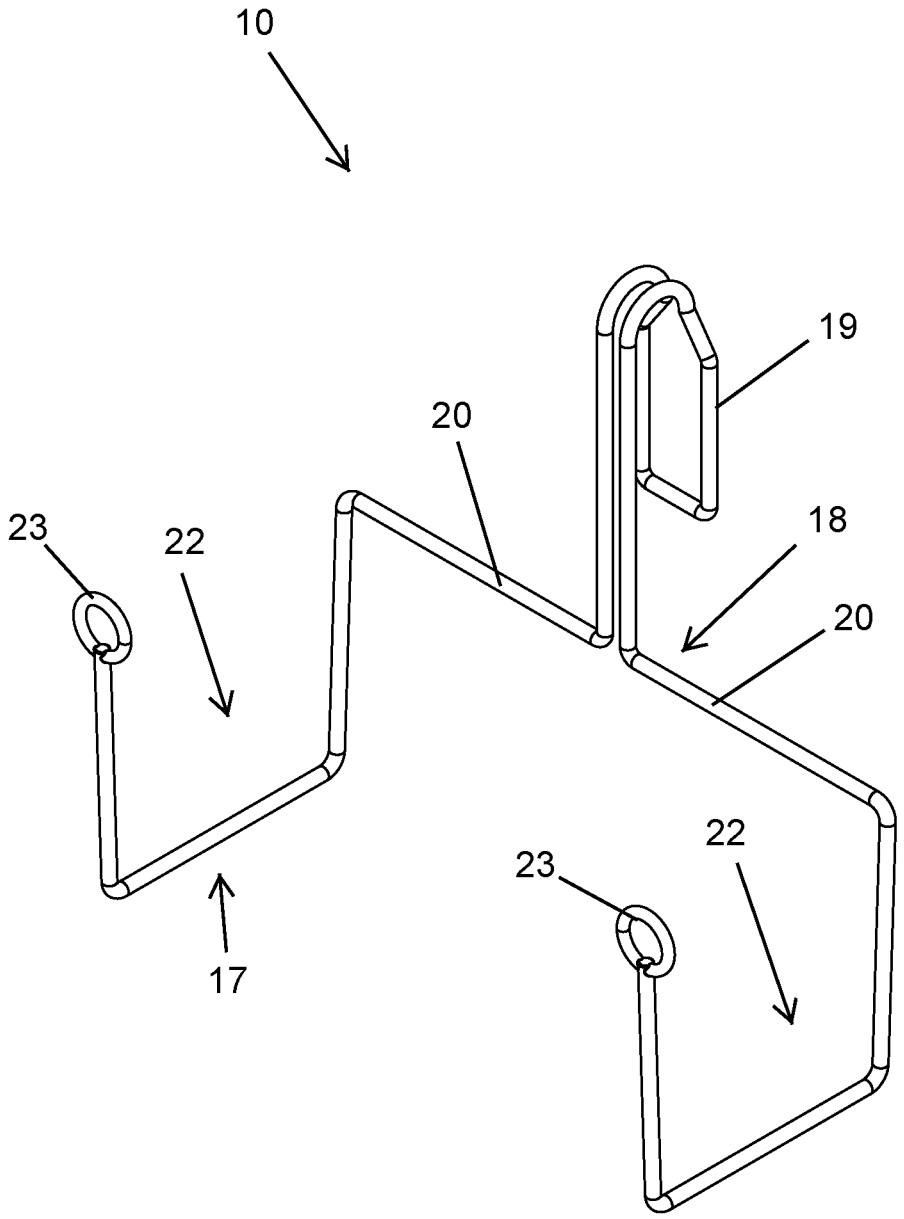

FIG. **6*a* is a cross-sectional view taken along line 6*a*-6*a* shown in FIG. 6; and FIG. 7 is a perspective view of the wire frame shown in FIG. 1**.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

A non-limiting exemplary embodiment(s) of the present disclosure is referred to generally in FIGS. 1-7 and is intended to provide a drywall accessory holder 10 including a lightweight and durable, easily transported, protective storage unit for a drywall mud-pan 16, glazing compound, or spackle, as well as a variety of putty and spackle knives (e.g., accessories 11). Equipped with a hook 19 for hanging from a wall, ladder, or other structure, the drywall accessory holder 10 keeps vital supplies and tools for drywall finishers, trades workers, repair work professionals, and household do-it-yourselfers, easily accessible, organized, and protected. It should be understood that the exemplary embodiment(s) may be used to hold a variety of drywall accessory, and should not be limited to any particular drywall accessory described herein.

The non-limiting exemplary embodiment(s) is/are referred to generally in FIGS. 1-7 and is/are intended to provide a drywall accessory holder 10 for keeping existing accessories 11 at a substantially stable position during drywall applications. The drywall accessory holder 10 includes a unitary and single receptacle 12 having an open top end and a centrally registered longitudinal axis 13 wherein the receptacle 12 is suitably sized and shaped for receiving and holding existing glazing compound and the existing accessories 11 therein. A wire frame 14 having a unitary, continuous, and predetermined shape is communicatively coupled to the receptacle 12 such that the receptacle 12 is maintained at a substantially stable position, and a lid 15 is pivotally coupled to the wire frame 14 in such a manner that the lid 15 is removably positioned entirely along the open top end of the receptacle 12. In this manner, the wire frame 14 is capable of being hung from an existing support structure.

In a non-limiting exemplary embodiment, the receptacle 12 is a drywall mud-pan 16 intercalated between an anterior portion 17 and a posterior portion 18 of the wire frame 14.

In a non-limiting exemplary embodiment, the wire frame 14 includes a hook 19 located at the posterior portion 18, a plurality of linear segments 20 oppositely extending laterally away from the hook 19, a plurality of U-shaped segments 22 attached to the linear segments 20, respectively, and extended towards the anterior portion 17, and a plurality of eyelets 23 connected to the U-shaped segments 22, respectively.

In a non-limiting exemplary embodiment, the lid 15 includes a plurality of linear slots 24 disposed parallel to the centrally registered longitudinal axis 13.

In a non-limiting exemplary embodiment, the wire frame 14 includes a plurality of fasteners 25 pivotally coupled to the eyelets 23 and the lid 15 such that the lid 15 is articulated, between an open position 26 and a closed position 27, about a fulcrum axis 28 oriented parallel to the centrally registered longitudinal axis 13.

In a non-limiting exemplary embodiment, a flexible wire strap 29 is spaced from the wire frame 14, the receptacle 12, and the lid 15. In this manner, the flexible wire strap 29 is selectively morphed to a desired shape and engaged to the existing accessories 11 for maintaining the existing accessories 11 at a substantially stable position during drywall applications. The flexible wire strap 29 is preferably non-resilient and keeps its morphed shape, as needed.

In a non-limiting exemplary embodiment, the lid 15 hangs downwardly and in front of the anterior portion 17 when adapted to the open position 26.

In a non-limiting exemplary embodiment, the receptacle 12 is cradled within the U-shaped segments 22.

The present disclosure further includes a method of utilizing a drywall accessory holder 10 for keeping existing accessories 11 at a substantially stable position during drywall applications. Such a method includes the steps of: providing a unitary and single receptacle 12 having an open top end and a centrally registered longitudinal axis 13 wherein the receptacle 12 is suitably sized and shaped for receiving and holding existing glazing compound and the existing accessories 11 therein; providing and communicatively coupling a wire frame 14 having a unitary, continuous, and predetermined shape to the receptacle 12 such that the receptacle 12 is maintained at a substantially stable position; providing and pivotally coupling a lid 15 to the wire frame 14 in such a manner that the lid 15 is removably positioned entirely along the open top end of the receptacle 12; and hanging the wire frame 14 from an existing support structure.

Referring in general to FIGS. 1-7, in a non-limiting exemplary embodiment, the drywall accessory holder 10 includes a 10-14 inch, sided rectangular receptacle 12—such as a drywall mud-pan 16 for holding several containers of glazing compound and/or ceiling and wall spackle, and featuring a hinged or removable lid 15 designed with form-fitting slots 24 to hold multiple, variously sized putty, spackle, knives, etc. in order to keep these protected, accessible, and organized. Preferably fabricated in rigid and durable, stamped, powder-coated aluminum or in heavy steel wire, wire frame 14 is equipped with a preformed hook 19 on the rear side thereof, permitting the receptacle 12 to be hung securely from a ladder, scaffold-rail, window-sill, or other structure, thus keeping the tools (e.g., knives, spackles, etc.) and materials needed for drywall work, glazing work, or spackling work both organized and where the worker needs them, in a single, easily portable unit.

Although intended primarily for the spackling work which precedes painting, the drywall accessory holder 10 could also be used to organize and hold a variety of other tools and supplies that one might need when working from a ladder or scaffold: knives, hammer and nails, pliers, electrical wire, painter's tape, and so forth. For use in spackling work, the drywall accessory holder 10 keeps everything needed—both spackling compound and putty knives—neat, clean, organized, protected, and ready to go at a moment's notice.

The drywall accessory holder 10 is an ideal accessory for a user who paints, spackles, or does home or structural improvements—and his conception and design for the holder 10 has been inspired by a personal need for such an accessory in his own work as a contractor. Preferably sold in home-improvement centers, paint stores, and hardware stores, etc., the drywall accessory holder 10 would thus be marketed to both the professional contractor and the do-it-yourself householder; and this all-in-one painting-prep accessory—clever in conception, thoughtful in design, and conceived to meet a real need shared by many users, should find a wide and enthusiastic market reception, both within the United States and around the world.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A drywall accessory holder for keeping existing accessories at a substantially stable position during drywall applications, said drywall accessory holder comprising:

a receptacle having an open top end and a centrally registered longitudinal axis, said receptacle being suitably sized and shaped for receiving and holding existing glazing compound and the existing accessories therein;

a wire frame having a predetermined shape communicatively coupled to said receptacle such that said receptacle is maintained at a substantially stable position; and a lid pivotally coupled to said wire frame in such a manner that said lid is removably positioned entirely along said open top end of said receptacle;

wherein said wire frame is capable of being hung from an existing support structure;

wherein said receptacle is a drywall mud-pan intercalated between an anterior portion and a posterior portion of said wire frame;

wherein said wire frame comprises a hook located at said posterior portion;

a plurality of linear segments oppositely extending laterally away from said hook;

a plurality of U-shaped segments attached to said linear segments, respectively, and extended towards said anterior portion; and a plurality of eyelets connected to said U-shaped segments, respectively;

wherein said lid comprises: a plurality of linear slots disposed parallel to the centrally registered longitudinal axis;

wherein said wire frame comprises: a plurality of fasteners pivotally coupled to said eyelets and said lid such that said lid is articulated, between an open position and a closed position, about a fulcrum axis oriented parallel to the centrally registered longitudinal axis;

a flexible wire strap spaced from said wire frame, said receptacle, and said lid; wherein said flexible wire strap is selectively morphed to a desired shape and engaged to the existing accessories for maintaining the existing accessories at a substantially stable position during drywall applications.

2. The drywall accessory holder of claim 1, wherein said lid hangs downwardly and in front of said anterior portion when adapted to said open position.

3. The drywall accessory holder of claim 2, wherein said receptacle is cradled within said U-shaped segments.

4. A drywall accessory holder for keeping existing accessories at a substantially stable position during drywall applications, said drywall accessory holder comprising:

a unitary and single receptacle having an open top end and a centrally registered longitudinal axis, said receptacle being suitably sized and shaped for receiving and holding existing glazing compound and the existing accessories therein;

a wire frame having a unitary, continuous, and predetermined shape communicatively coupled to said receptacle such that said receptacle is maintained at a substantially stable position; and a lid pivotally coupled to said wire frame in such a manner that said lid is removably positioned entirely along said open top end of said receptacle;

wherein said wire frame is capable of being hung from an existing support structure;

wherein said receptacle is a drywall mud-pan intercalated between an anterior portion and a posterior portion of said wire frame;

wherein said wire frame comprises a hook located at said posterior portion;

a plurality of linear segments oppositely extending laterally away from said hook;

a plurality of U-shaped segments attached to said linear segments, respectively, and extended towards said anterior portion; and a plurality of eyelets connected to said U-shaped segments, respectively;

wherein said lid comprises: a plurality of linear slots disposed parallel to the centrally registered longitudinal axis;

wherein said wire frame comprises: a plurality of fasteners pivotally coupled to said eyelets and said lid such that said lid is articulated, between an open position and a closed position, about a fulcrum axis oriented parallel to the centrally registered longitudinal axis;

a flexible wire strap spaced from said wire frame, said receptacle, and said lid; wherein said flexible wire strap is selectively morphed to a desired shape and engaged to the existing accessories for maintaining the existing accessories at a substantially stable position during drywall applications.

5. The drywall accessory holder of claim 4, wherein said lid hangs downwardly and in front of said anterior portion when adapted to said open position.

6. The drywall accessory holder of claim 5, wherein said receptacle is cradled within said U-shaped segments.

7. A method of utilizing a drywall accessory holder for keeping existing accessories at a substantially stable position during drywall applications, said method comprising the steps of:

providing a unitary and single receptacle having an open top end and a centrally registered longitudinal axis, said receptacle being suitably sized and shaped for receiving and holding existing glazing compound and the existing accessories therein;

providing and communicatively coupling a wire frame having a unitary, continuous, and predetermined shape to said receptacle such that said receptacle is maintained at a substantially stable position;

providing and pivotally coupling a lid to said wire frame in such a manner that said lid is removably positioned entirely along said open top end of said receptacle; and hanging said wire frame from an existing support structure;

wherein said receptacle is a drywall mud-pan intercalated between an anterior portion and a posterior portion of said wire frame;

wherein said wire frame comprises a hook located at said posterior portion;

a plurality of linear segments oppositely extending laterally away from said hook;

a plurality of U-shaped segments attached to said linear segments, respectively, and extended towards said anterior portion; and a plurality of eyelets connected to said U-shaped segments, respectively;

wherein said lid comprises: a plurality of linear slots disposed parallel to the centrally registered longitudinal axis;

wherein said wire frame comprises: a plurality of fasteners pivotally coupled to said eyelets and said lid such that said lid is articulated, between an open position and a closed position, about a fulcrum axis oriented parallel to the centrally registered longitudinal axis;

a flexible wire strap spaced from said wire frame, said receptacle, and said lid; wherein said flexible wire strap is selectively morphed to a desired shape and engaged to the existing accessories for maintaining the existing accessories at a substantially stable position during drywall applications.

* * * * *